US005513084A

United States Patent [19]

Simpson

[11] Patent Number: 5,513,084

[45] Date of Patent: Apr. 30, 1996

[54] HOLIDAY LIGHTING DECORATION AND METHOD

[76] Inventor: Ted L. Simpson, 231 Banbury Rd., Columbia, S.C. 29210

[21] Appl. No.: 499,866

[22] Filed: Jul. 10, 1995

[51] Int. Cl.[6] ..... F21V 21/30

[52] U.S. Cl. ..... 362/284; 362/35; 362/311; 362/806

[58] Field of Search ..... 362/284, 35, 311, 362/806; 40/574, 575, 431

[56] References Cited

U.S. PATENT DOCUMENTS 4,562,980 3/1987 Segan ..... 362/806
4,682,079 10/1984 Sanders et al. ..... 362/806
4,858,079 8/1989 Ohashi ..... 362/35
4,989,120 1/1991 Davis et al. ..... 362/35

*Primary Examiner*—Denise L. Gromada
*Assistant Examiner*—Alfred Basichas
*Attorney, Agent, or Firm*—Ralph Bailey

[57] ABSTRACT

A Christmas tree decoration has a motor driven carousel (A) for displaying a series of images on a transparent film strip (B). A hollow transparent support (C) is provided for supplying an upright receptacle for retention of the photographs upon the carousel for rotation therewith for sequentially displaying the images on the film strip. A light bulb (D) provides the necessary illumination and a hanger (E) is provided for suspension of the Christmas tree.

5 Claims, 2 Drawing Sheets

Fig. 1.
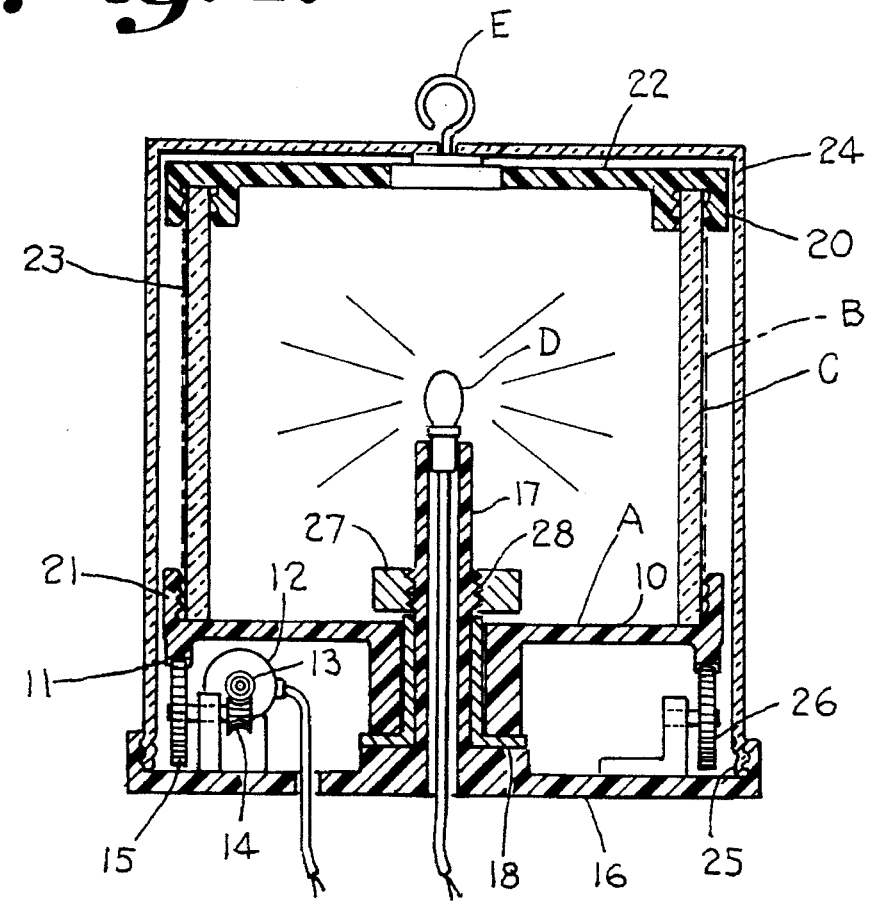
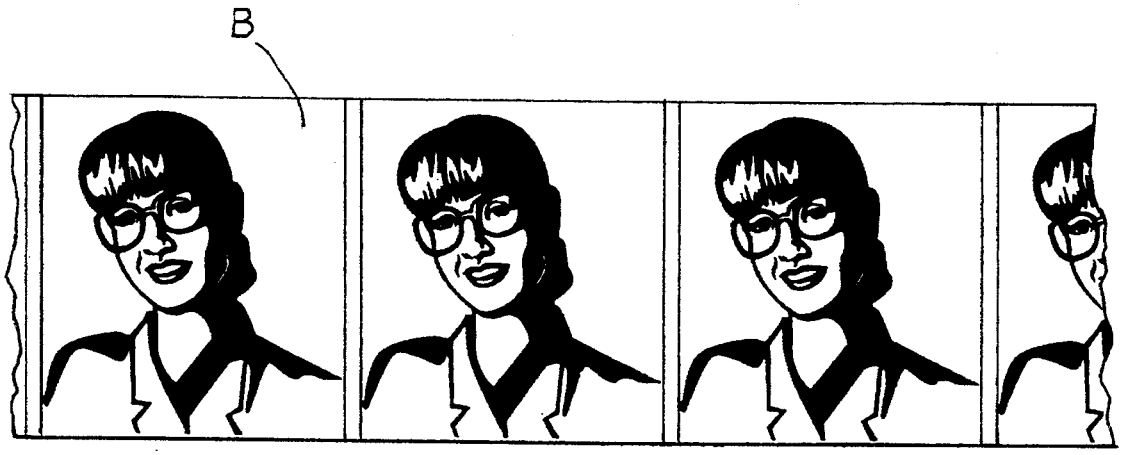
Fig. 2.

HOLIDAY LIGHTING DECORATION AND METHOD

BACKGROUND OF THE INVENTION

This invention relates to a decoration for a Christmas tree having a motor driven carousel for displaying a series of transparent images supported about a Christmas tree light preferably carried on a string of lights.

Motor driven carousels have been utilized for Christmas tree decorations incorporating a lamp in the form of a standard Christmas tree light utilized as part of a string of lights. Carousel arrangements are illustrated in U.S. Pat. Nos. 4,682,079 and 4,989,120. These Christmas tree decorations utilize a housing formed of two hemispherical hollow upper and lower members containing a motor driven carousel carrying a sculptured display. The display is illustrated as being in the form of a landscape including animal and human figures, buildings, vehicles and the like. Once such a three-dimensional display has been selected it cannot be changed and the user has no means of altering the display material so as to personalize the display such as by securing a series of images such as incorporating transparent photographs of any desired type including individuals and landscapes of any kind having personal significance to the user.

The prior art is further illustrated by U.S. Pat. No. 4,173,038 which describes the use of a motor driven carousel which itself contains a string of lights and which carries a pattern of cutout images for displaying a kaleidoscope of images in various changing colors. The image device is carried by a stand and is not suitable for use as a Christmas tree decoration or as a means for personalized display.

SUMMARY OF THE INVENTION

Accordingly, it is an important object of this invention to provide a Christmas tree decoration capable of displaying personalized images selected by the user.

Another object of this invention is to provide an attractive carousel Christmas tree decoration capable of displaying moving images on a transparent strip to enhance the appearance of the Christmas tree.

Another important object is to provide a Christmas decoration which is distinctive and capable of alteration by the user to display a variety of images which rotate in carousel fashion and are utilized on a Christmas tree alone or as an ornament in a light string.

The decoration includes a transparent hollow support which is carried by or serves as a part of a carousel which is mounted to be driven by a motor supplied with power from a string of Christmas tree lights and which contains a light which forms one of a string of Christmas tree lights for illuminating a series of images carried by an upright receptacle defined by the support which is preferably cylindrical offering support for a strip of photographs or other transparent images for display on a Christmas tree as one of a string of lights.

Images may be supplied for purchase by a user of the Christmas tree ornament and, if desired, personalized images may be substituted therefor.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a sectional elevation illustrating a carousel display arrangement for illumination by a Christmas tree bulb with transparent images thereabout constructed in accordance with the present invention;

FIG. 2 is a series of photographs of personal interest to the user of the Christmas tree facilitating their positioning about a motor driven support forming the carousel;

DESCRIPTION OF A PREFERRED EMBODIMENT

Figure 3:
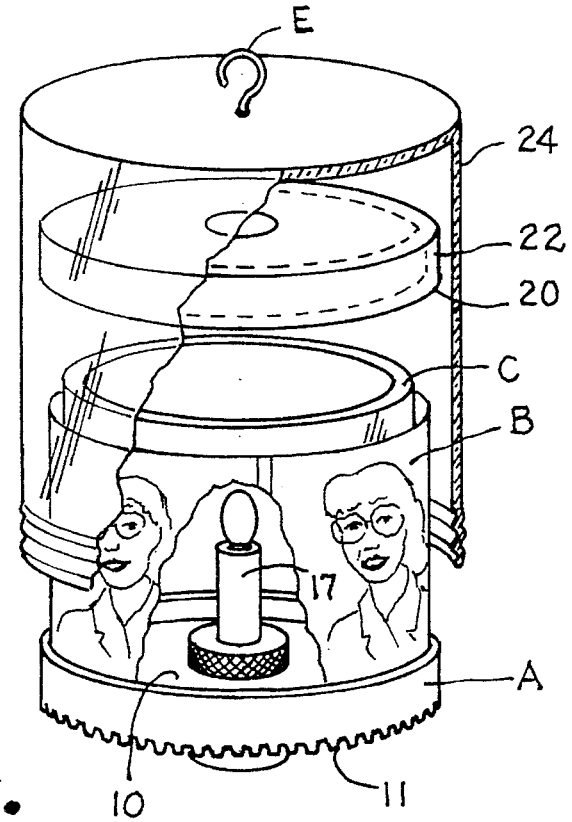
FIG. 3 is a perspective view illustrating the carousel with a transparent image strip in position for display upon the carousel.
Figure 4:
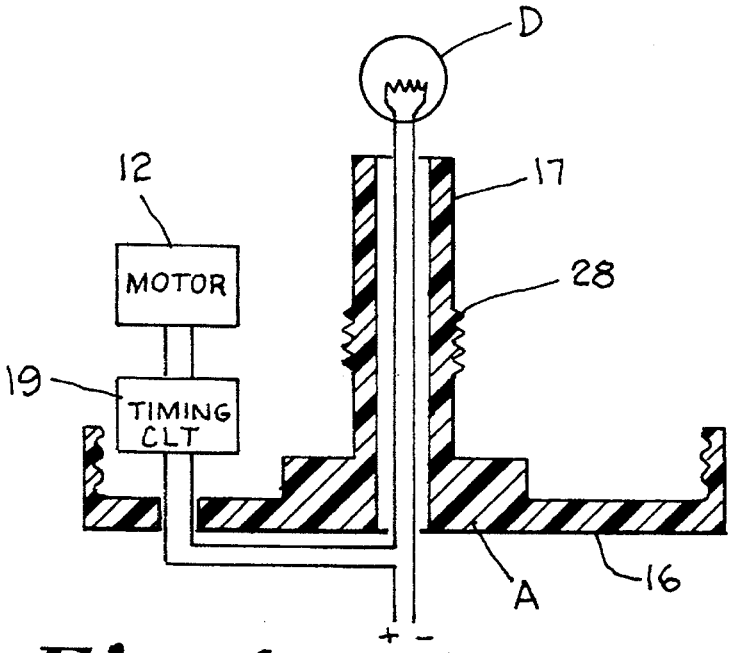
FIG. 4 illustrates a motor driven carousel base and lamp post constructed in accordance with the invention.

The drawings illustrate a decoration for a Christmas tree including a motor driven carousel A. A series of transparent images for display upon the carousel is illustrated as being in the form of a transparent strip of photographs of subjects of personal interest to the user. These images are displayed upon a transparent hollow support C which is carried by the carousel defining an upright support on the carousel for positioning the transparent images thereabout. A Christmas tree light D is carried centrally within the hollow support. The images are of such size as to be disposed in a receptacle preferably of generally cylindrical configuration as to be effectively illuminated by a standard Christmas tree light and are of convenient size to be suspended from the tree on a hanger E preferably being a part of a string of Christmas tree lights.

The carousel is illustrated as being motor driven and as including a driven base member 10 which has a speed reduction rack gear illustrated at 11 on the driving edge thereof. The rack gear is driven by a motor 12 by means of a worm 13 and worm gear 14. The worm gear in turn drives a pinion 15 for engagement with the rack gear. Preferably the motor is driven by a suitable timing circuit 19 for delivering energy in the form of pulses producing a relative steady motion for the carousel. The motor 12 is mounted on a housing 16 which in turn carries a centrally disposed lamp post 17 which has a bearing in the form of a plastic washer 18 for mounting the carousel A thereon.

A transparent hollow stand or three-dimensional support is carried by the carousel A and defines an upright receptacle on the support for positioning the series of transparent or translucent images such as the photographic transparencies of the strip B. The images of the transparent strip are illustrated as being vertically supported within the upright cylindrical receptacle illustrated in FIG. 1 as being formed between an upper groove 20 and a flange 21 carried by the base member 10 of the carousel A. The film strip B may be positioned by removing the top 22 of the support which is preferably of a snap-on variety capable of being secured within a transparent support cage 23.

An external housing is illustrated at 24 and is constructed of transparent or translucent material as are the image strips and rotating support cage 23.

The clear outside housing 24 surrounds the light bulb D and carries the hanger E thereon for suspending the ornament from a Christmas tree. Preferably the clear housing 24 is threadably secured to the housing 16 as at 25. If desired, an idler gear 26 may be provided for stabilizing the rotation of the carousel. A captivating nut 27 is threadably secured as at 28 to the lamp post 17 in order to position the carousel A for rotation upon the bearing 18.

It is thus seen that a highly ornamental Christmas tree decoration has been provided in the form of a light capable of utilization as a part of a string of lights. The decoration may be altered by the user to display personalized images such as photographs of family members and the like. Decorations constructed in accordance with the present invention may be advantageously collected or new variations personalized and added from year to year.

While a preferred embodiment of the invention has been described using specific terms, such description is for illustrative purposes only, and it is to be understood that changes and variations may be made without departing from the spirit or scope of the following claims.

What is claimed is:

1. A decoration for a Christmas tree comprising:

a motor driven carousel;

a series of transparent images for display upon said carousel;

a transparent hollow support carried by said carousel defining an upright receptacle on said support for positioning said series of transparent images thereabout;

a Christmas tree light centrally carried within said hollow support;

said images being of such size and disposed in said receptacle in a configuration as to be effectively illuminated by a standard Christmas tree light bulb; and a hanger for suspending said carousel from the Christmas tree;

whereby personalized images may be displayed on an illuminated decoration.

2. The structure set forth in claim 1 wherein a drive motor is connected to a carousel by a worm gear drive beneath said carousel.

3. The structure set forth in claim 1 including a transparent housing carrying a hook at a top for suspending an ornament on the tree and for supporting and for carrying said motor.

4. The structure set forth in claim 3 wherein said motor is driven by a pulse drive.

5. The method of decorating a Christmas tree comprising the steps of:

providing a motor driven carousel;

positioning a transparent generally cylindrical support on said carousel;

mounting a series of transparent images on said cylindrical support;

securing a central tree lighting bulb within said cylindrical support; and suspending said carousel from a Christmas tree whereby said images may be displayed as a part of a Christmas tree ornament.

* * * * *